US011827322B2

(12) United States Patent
Tsukada et al.

(10) Patent No.: US 11,827,322 B2
(45) Date of Patent: Nov. 28, 2023

(54) OUTBOARD MOTOR

(71) Applicant: YAMAHA HATSUDOKI KABUSHIKI KAISHA, Iwata (JP)

(72) Inventors: Junya Tsukada, Shizuoka (JP); Hikaru Yasukawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 120 days.

(21) Appl. No.: 17/327,820

(22) Filed: May 24, 2021

(65) Prior Publication Data

US 2022/0017198 A1 Jan. 20, 2022

(30) Foreign Application Priority Data

Jul. 16, 2020 (JP) ..... 2020-121892

(51) Int. Cl.
*B63H 1/26* (2006.01)
*B63H 1/16* (2006.01)
*B63H 20/32* (2006.01)

(52) U.S. Cl.
CPC ..... *B63H 1/26* (2013.01); *B63H 1/16* (2013.01); *B63H 20/32* (2013.01)

(58) Field of Classification Search
CPC ..... B63H 1/16; B63H 1/26; B63H 20/007; B63H 20/32; B63H 23/00; B63H 2023/005; B63H 21/17
USPC ..... 440/66, 67
See application file for complete search history.

(56) References Cited

U.S. PATENT DOCUMENTS

| | | | | |
|---|---|---|---|---|
| 5,964,626 | A | 10/1999 | Varney et al. | |
| 8,299,669 | B2 * | 10/2012 | Gieras | B63H 23/24 310/87 |
| 8,956,195 | B2 * | 2/2015 | Suzuki | B63H 20/00 440/2 |
| 2013/0115832 | A1 | 5/2013 | Suzuki et al. | |

FOREIGN PATENT DOCUMENTS

| | | | |
|---|---|---|---|
| JP | 07-323888 | A | 12/1995 |
| JP | 08-108889 | A | 4/1996 |
| JP | 08-108890 | A | 4/1996 |
| JP | 10-244993 | A | 9/1998 |
| WO | 2018/083370 | A1 | 5/2018 |

OTHER PUBLICATIONS

Official Communication issued in corresponding European Patent Application No. 21167626.7, dated Sep. 24, 2021.

* cited by examiner

*Primary Examiner* — Daniel V Venne
(74) *Attorney, Agent, or Firm* — Keating & Bennett, LLP

(57) ABSTRACT

An outboard motor includes a duct, a propeller, a central shaft, and a plurality of fins. The duct includes a circular hole. The propeller is located in the circular hole. The propeller includes a boss and a plurality of blades radially extending from the boss. The central shaft rotatably supports the propeller. The plurality of fins radially extend from the central shaft and connect the central shaft and the duct. The plurality of fins define an airfoil profile.

8 Claims, 6 Drawing Sheets

OUTBOARD MOTOR

CROSS REFERENCE TO RELATED APPLICATIONS

This application claims the benefit of priority to Japanese Patent Application No. 2020-121892 filed on Jul. 16, 2020. The entire contents of this application are hereby incorporated herein by reference.

BACKGROUND OF THE INVENTION

1. Field of the Invention

The present invention relates to an outboard motor.

2. Description of the Related Art

An outboard motor is equipped with a propeller, and a propulsive force for propelling a boat is generated by rotating the propeller. For example, an outboard motor disclosed in Japan Laid-open Patent Publication JP-A-10-244993 includes a duct and a propeller. The duct has a circular hole. The propeller is located in the hole. The propeller is supported by the duct via a fluid bearing.

In the above-described outboard motor, when the propeller is supported by the duct via the central shaft without a fluid bearing, the support rigidity of the propeller is improved by connecting the central shaft to the duct via a plurality of fins. However, in that case, the fins interfere with the wake of the propeller, which causes resistance to the rotation of the propeller. As a result, the propulsion performance of the outboard motor deteriorates.

SUMMARY OF THE INVENTION

Preferred embodiments of the present invention improve support rigidity of a propeller and propulsion performance of an outboard motor.

An outboard motor according to a preferred embodiment of the present invention includes a duct, a propeller, a central shaft, and a plurality of fins. The duct includes a circular hole. The propeller is located in the hole. The propeller includes a boss and a plurality of blades extending radially from the boss. The central shaft rotatably supports the propeller. The plurality of fins extend radially from the central shaft. The plurality of fins connect the central shaft and the duct. The plurality of fins have an airfoil profile.

In an outboard motor according to a preferred embodiment of the present invention, the plurality of fins connect the central shaft and the duct. Therefore, the support rigidity of the propeller is improved. Further, the plurality of fins have an airfoil profile. Therefore, a force generated by a swirling flow from the propeller is recovered by the fins as a force to propel the outboard motor. As a result, the propulsion performance of the outboard motor is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
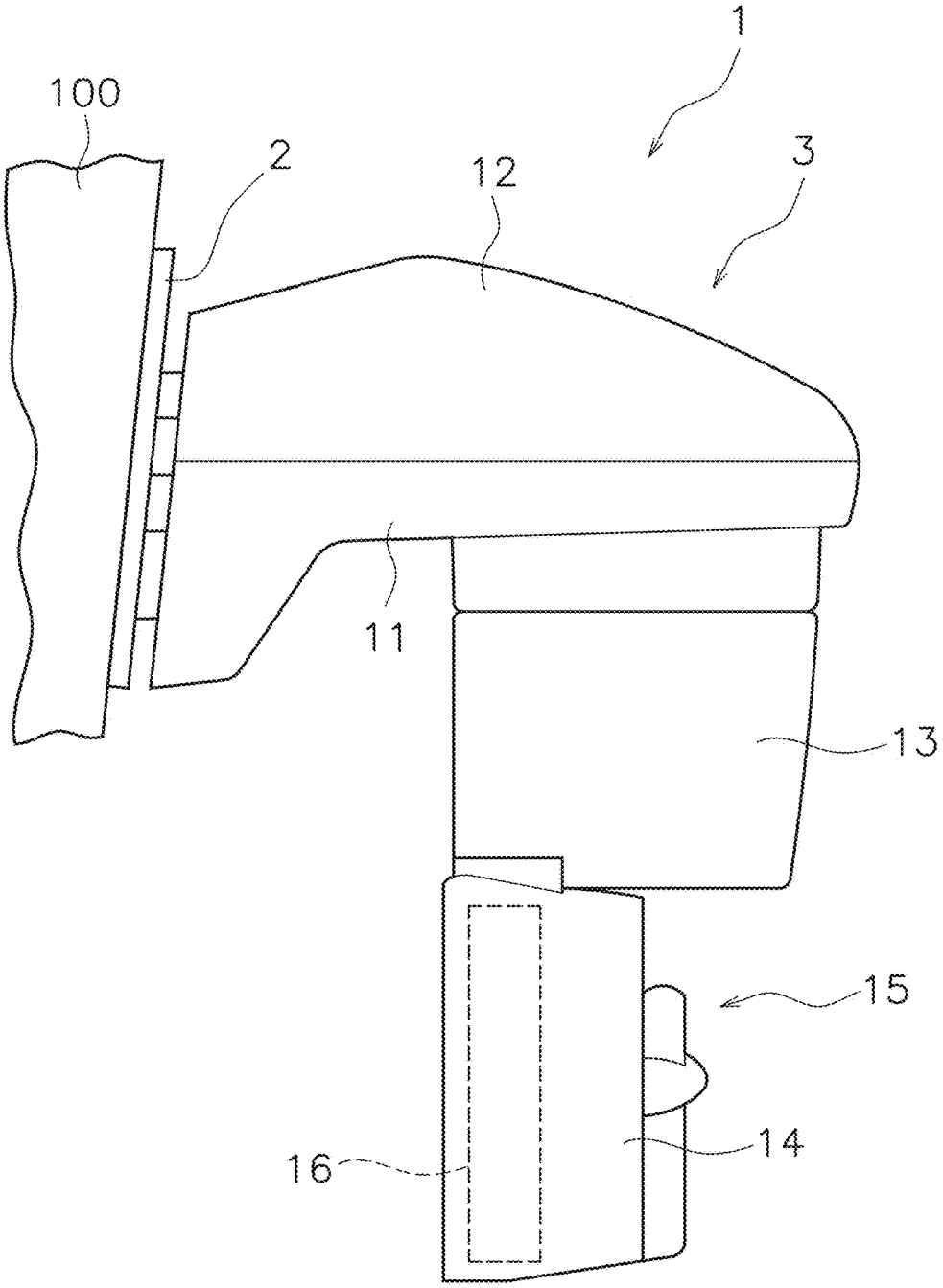
FIG. 1 is a side view of an outboard motor according to a preferred embodiment of the present invention.
Figure 2:
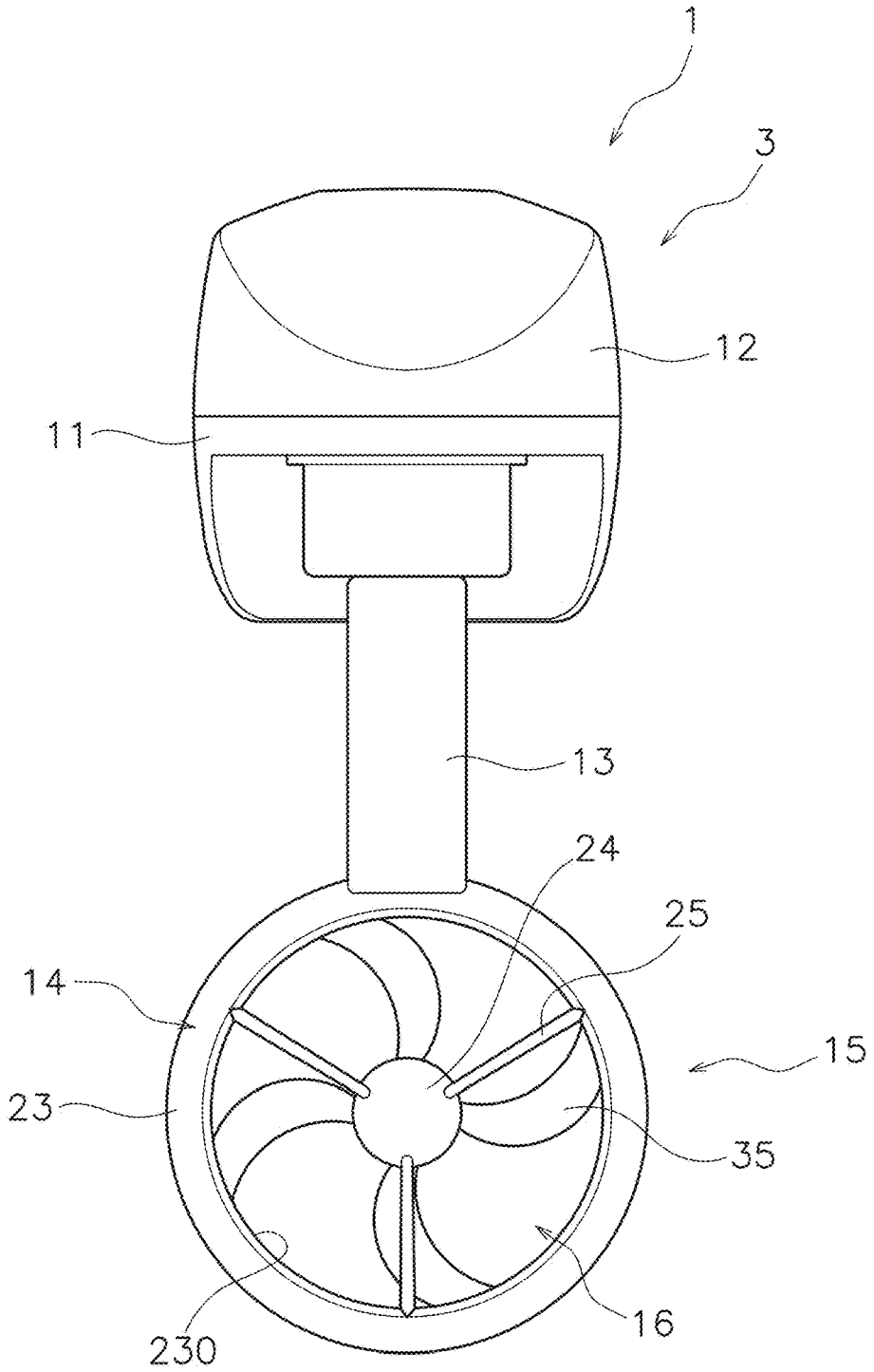
FIG. 2 is a rear view of the outboard motor.

Hereinafter, outboard motors according to preferred embodiments of the present invention will be described with reference to the drawings. FIG. 1 is a side view of an outboard motor 1 according to a preferred embodiment of the present invention. FIG. 2 is a rear view of the outboard motor 1. As illustrated in FIG. 1, the outboard motor 1 is attached to a stern of a boat 100. The outboard motor 1 includes a bracket 2 and an outboard motor body 3. The bracket 2 is attached to the boat 100. The outboard motor 1 is attached to the boat 100 via the bracket 2. The outboard motor body 3 is supported by the bracket 2.

The outboard motor body 3 includes a base 11, a cowl 12, an upper housing 13, and a drive unit 15. The base 11 is connected to the bracket 2. The cowl 12 is located above the base 11. The cowl 12 is attached to the base 11. The upper housing 13 is located below the base 11. The upper housing 13 extends downward from the base 11. The drive unit 15 is located below the upper housing 13. The drive unit 15 generates a thrust to propel the boat 100.

The drive unit 15 includes a lower housing 14 and a propeller 16. The lower housing 14 is located below the upper housing 13. The propeller 16 is located in the lower housing 14.

Figure 3:
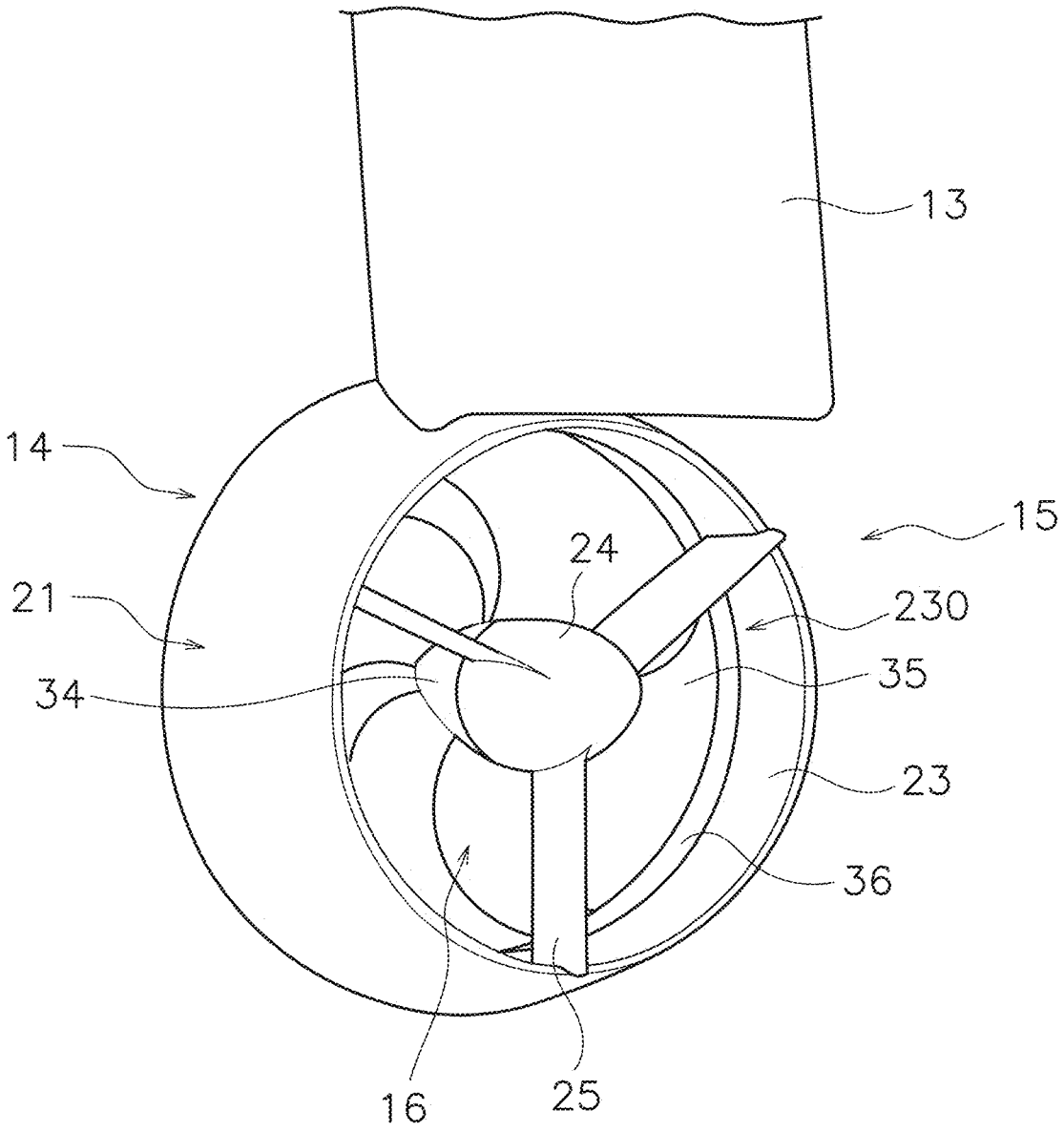
FIG. 3 is a perspective view of a drive unit.
Figure 4:
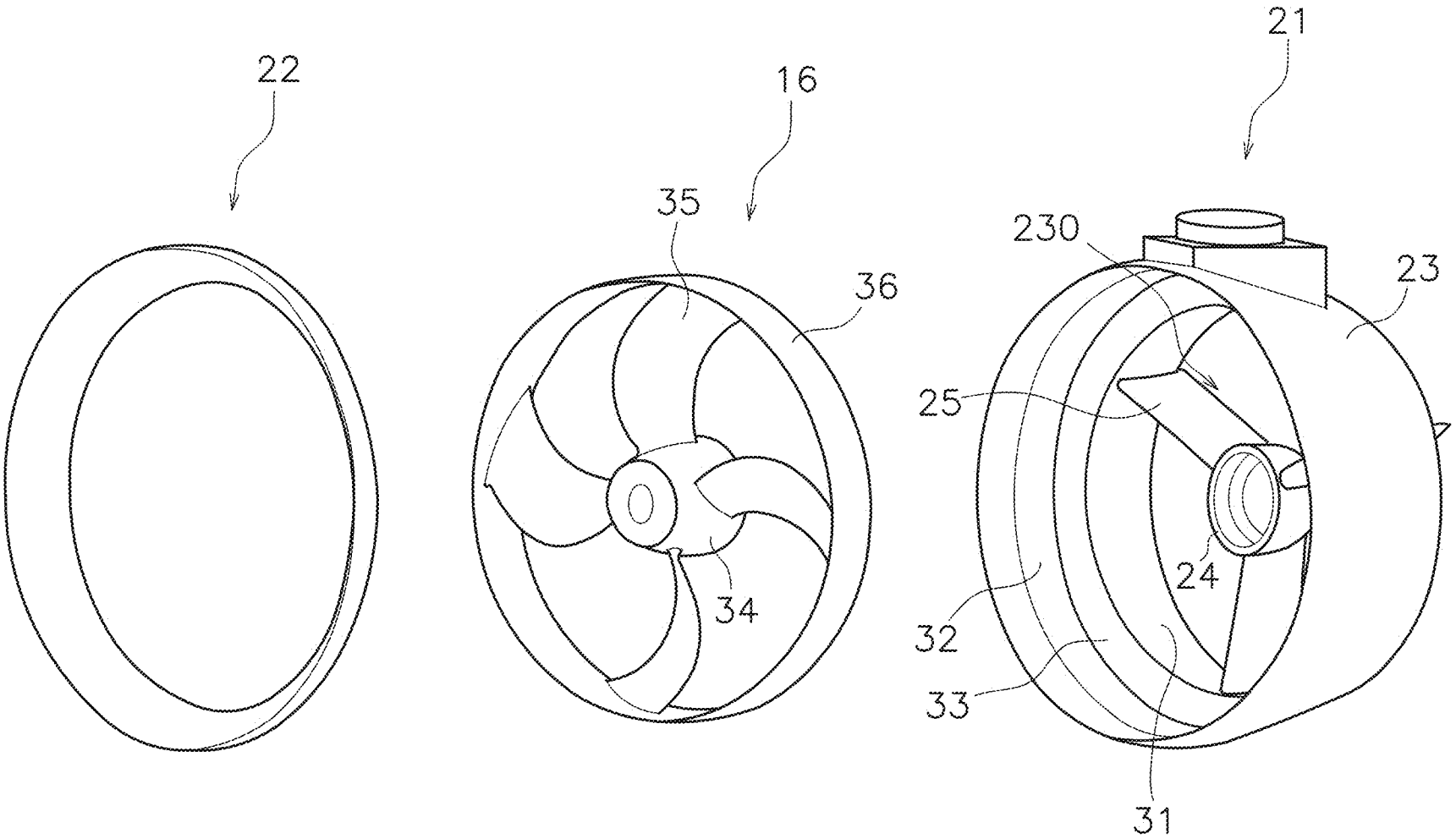
FIG. 4 is an exploded view of the drive unit.

FIG. 3 is a perspective view of the drive unit 15. FIG. 4 is an exploded view of the drive unit 15. As illustrated in FIGS. 3 and 4, the lower housing 14 includes a duct 21 and a duct cap 22. The duct 21 has a tubular shape. The duct 21 includes a duct ring 23, a central shaft 24, and a plurality of fins 25. In the drawings, reference numeral 25 indicates only some of the plurality of fins 25, and the reference numerals 25 of the other fins 25 are omitted.

The duct ring 23 has a tubular shape. The duct ring 23 includes a circular hole 230. As illustrated in FIG. 4, the duct ring 23 includes a first inner peripheral surface 31, a second inner peripheral surface 32, and a step 33. The second inner peripheral surface 32 is located forward of the first inner peripheral surface 31. An inner diameter of the second inner peripheral surface 32 is larger than an inner diameter of the first inner peripheral surface 31. The step 33 is located between the first inner peripheral surface 31 and the second inner peripheral surface 32. The central shaft 24 is located at a center of the duct ring 23. The central shaft 24 has a tubular shape. A back surface of the central shaft 24 has a curved shape. The central shaft 24 rotatably supports the propeller 16.

The plurality of fins 25 and the central shaft 24 are located in the hole 230 of the duct ring 23. The plurality of fins 25 extend radially from the central shaft 24. The plurality of fins 25 connect the central shaft 24 and the duct ring 23. The plurality of fins 25 are connected to the first inner peripheral surface 31. In the present preferred embodiment, the number of fins 25 is three. However, the number of fins 25 may be less than three or more than three.

The propeller 16 is located in the hole 230 of the duct ring 23. The propeller 16 is located forward of the fin 25. The propeller 16 includes a boss 34, a plurality of blades 35, and a rotor 36. The boss 34 has a tubular shape. The boss 34 is located in a center of the rotor 36. The boss 34 and the plurality of blades 35 extend radially inward from the rotor 36. The boss 34 is rotatably supported by the central shaft 24 of the duct 21. The plurality of blades 35 extend radially from the boss 34. The plurality of blades 35 are connected to the boss 34 and the rotor 36. In the drawings, reference numeral 35 indicates only some of the plurality of blades 35, and reference numerals of the other blades 35 are omitted.

The number of blades 35 is preferably different from the number of fins 25. For example, the number of fins 25 is odd and the number of blades 35 is even. In the present preferred embodiment, the number of blades 35 is four. However, the number of blades 35 is not limited to four, and may be less than four or more than four. The rotor 36 has a ring shape. An outer diameter of the rotor 36 is larger than an inner diameter of the first inner peripheral surface 31. The outer diameter of the rotor 36 is smaller than an inner diameter of the second inner peripheral surface 32. Therefore, the outer peripheral surface of the rotor 36 has a gap with respect to the second inner peripheral surface 32. The rotor 36 is located forward of the step 33. The rotor 36 is located between the step 33 and the duct cap 22.

The duct cap 22 is attached to the duct 21. The duct cap 22 has a ring shape. The duct cap 22 is located forward of the propeller 16. An inner diameter of the duct cap 22 is smaller than the outer diameter of the rotor 36. The inner diameter of the first inner peripheral surface 31, the inner diameter of the rotor 36, and the inner diameter of the duct cap 22 are the same or substantially the same. That is, the first inner peripheral surface 31, the inner peripheral surface of the rotor 36, and the inner peripheral surface of the duct cap 22 are flush or substantially flush with each other. The duct cap 22 prevents the propeller 16 from coming off.

Figure 5:
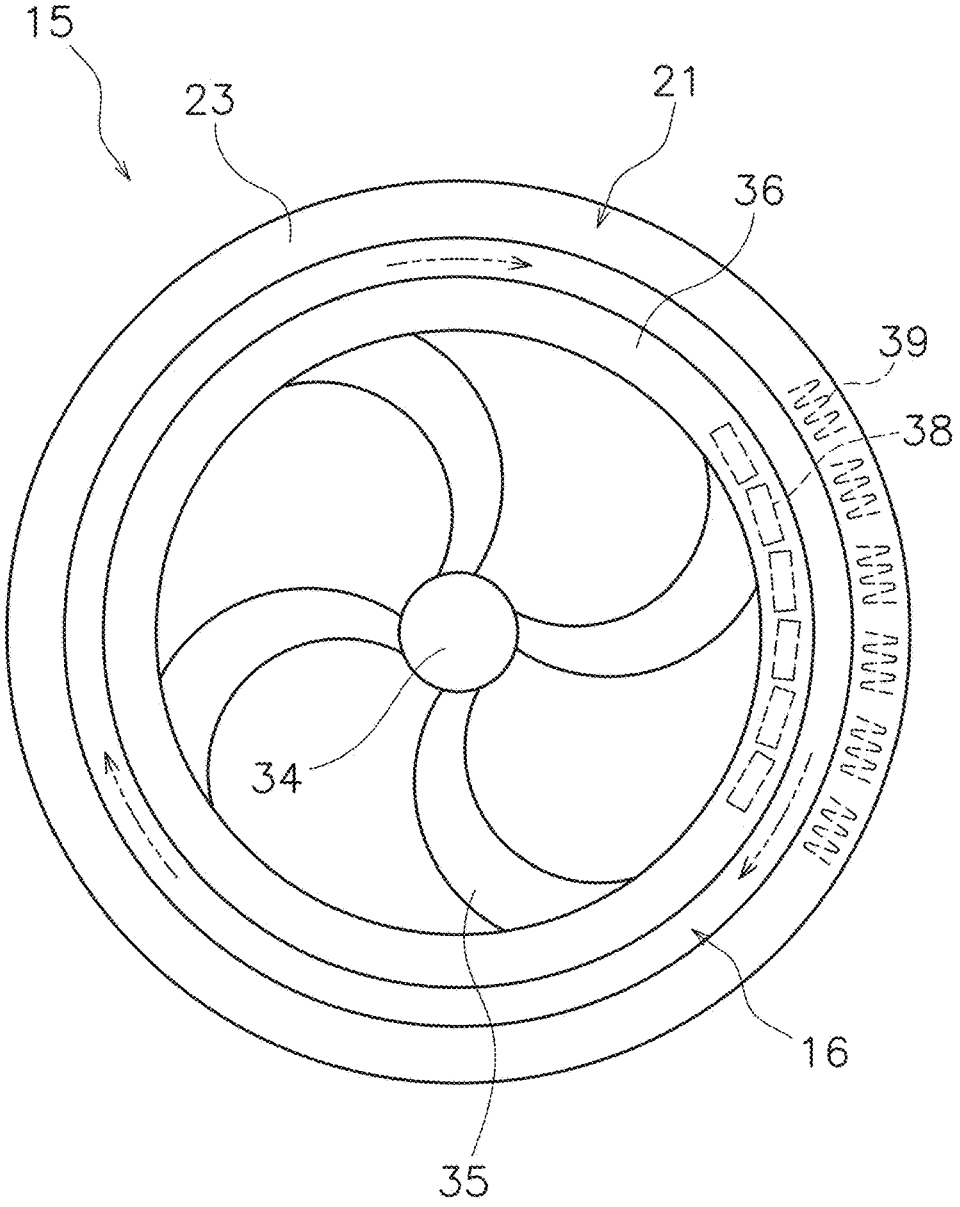
FIG. 5 is a schematic view showing a configuration of the drive unit.

FIG. 5 is a schematic view showing the configuration of the drive unit 15. As illustrated in FIG. 5, the propeller 16 includes a plurality of permanent magnets 38. The plurality of permanent magnets 38 are provided at the rotor 36. The plurality of permanent magnets 38 are located along the circumferential direction of the rotor 36. In FIG. 5, reference numeral 38 indicates only one of the plurality of permanent magnets 38, and the reference numerals of the other permanent magnets 38 are omitted.

The duct 21 includes a plurality of stator coils 39. The plurality of stator coils 39 are provided at the duct ring 23. The plurality of stator coils 39 are located along the circumferential direction of the duct ring 23. By energizing the plurality of stator coils 39, an electromagnetic force that rotates the rotor 36 is generated. As a result, the propeller 16 rotates and propels the boat 100. In FIG. 5, reference numeral 39 indicates only one of the plurality of stator coils 39, and the reference numerals of the other stator coils 39 are omitted.

Figure 6:
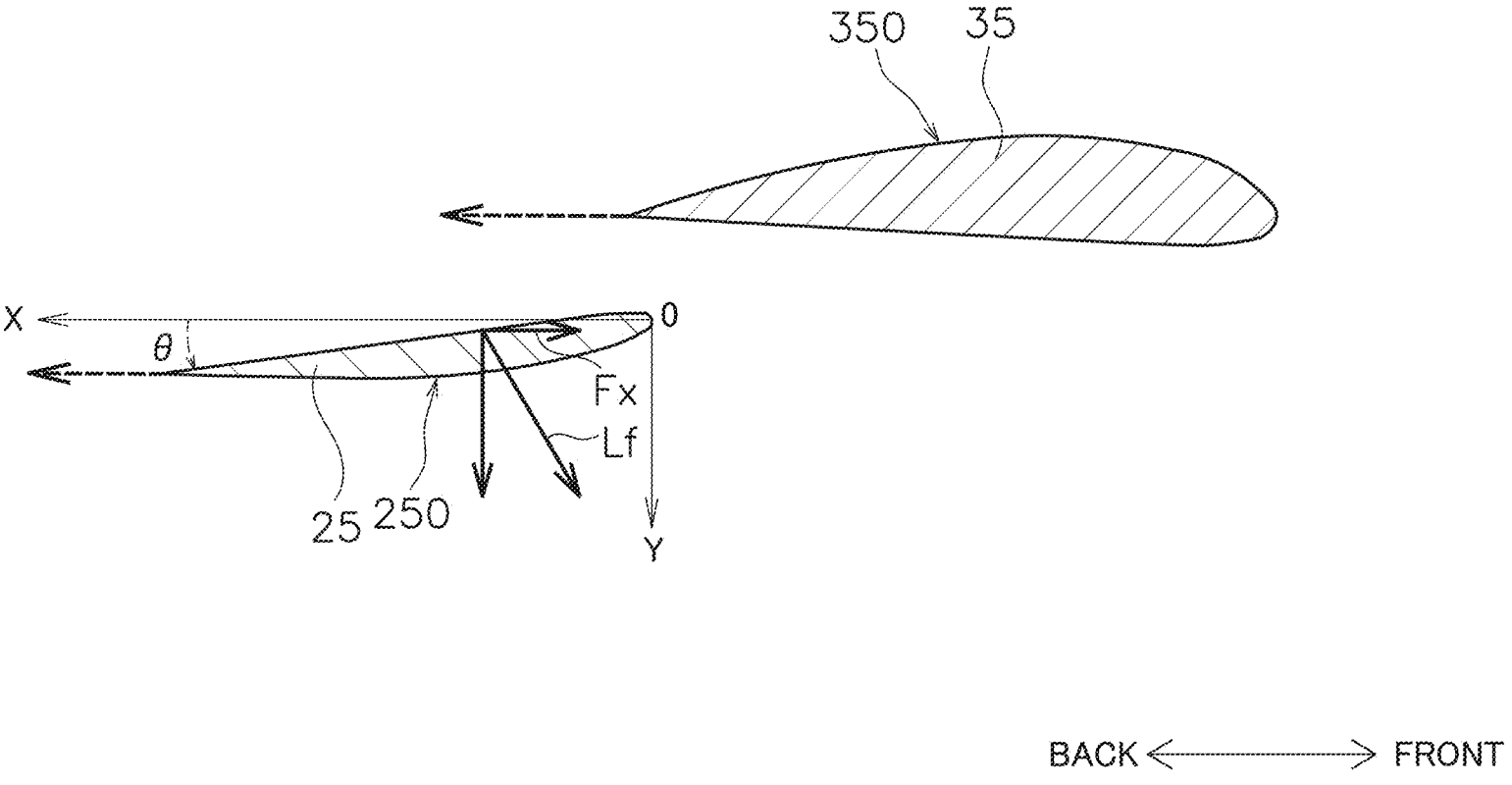
FIG. 6 is a cross-sectional view of a blade and a fin.

When the propeller 16 rotates in a direction of advancing the boat 100, a swirling flow of water is generated by the propeller 16. The swirling flow flows backward from the blades 35 of the propeller 16. The fins 25 are located behind or rearward of the blades 35. Therefore, the fins 25 receive a force due to the swirling flow. FIG. 6 is a view showing a cross section of one blade 35 and one fin 25 of the propeller 16. As illustrated in FIG. 6, the fin 25 has an airfoil profile.

A force Lf that pushes the fin 25 acts on the fin 25 due to the swirling flow from the blade 35. The fin 25 has an airfoil profile that converts the force Lf pushing the fin 25 into a forward thrust Fx. The surface 250 on the negative pressure side of the fin 25 and the surface 350 on the negative pressure side of the blade 35 face each other in opposite directions.

A pitch angle of the fin 25 is set so that the forward thrust Fx is maximized. For example, the pitch angle of the fin 25 is preferably about 4 degrees or less and about −7 degrees or more. The pitch angle θ illustrated in FIG. 6 indicates a pitch angle in the minus direction. The ratio of the maximum camber to the chord length of the fin 25 is set so that the forward thrust Fx is the maximum. For example, the ratio of the maximum camber to the chord length of the fin 25 is preferably about 5% or more and about 9% or less.

In the outboard motor 1 according to the preferred embodiments described above, the plurality of fins 25 connect the central shaft 24 and the duct ring 23. Therefore, the support rigidity of the propeller 16 is improved. Further, each of the plurality of fins 25 has the airfoil profile. Therefore, the force generated by the swirling flow from the propeller 16 is recovered by the fins 25 as a force to propel the outboard motor 1. Thus, the propulsion performance of the outboard motor 1 is improved.

Although preferred embodiments of the present invention have been described above, the present invention is not limited to the above-described preferred embodiments, and various modifications can be made without departing from the gist of the present invention.

The configuration of the outboard motor 1 is not limited to that of the above-described preferred embodiments, and may be changed. For example, the drive unit 15 may include an internal combustion engine. That is, the outboard motor 1 may rotate the propeller 16 by the driving force of the internal combustion engine. The internal combustion engine may be located within the cowl 12.

In the above-described preferred embodiments, the number of fins 25 is odd and the number of blades 35 is even. However, the number of blades 35 may be odd and the number of fins 25 may be even. The fins 25 may be located in front or forward of the propeller 16, and is not limited to being located rearward of the propeller 16. In that case, when the boat 100 is moved backward, the force generated by the swirling flow from the propeller 16 is recovered by the fins 25 as the force to propel the outboard motor 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a duct including a circular hole;

a propeller located in the circular hole and including a boss and a plurality of blades radially extending from the boss;

a central shaft that rotatably supports the propeller; and a plurality of fins extending radially from the central shaft and connecting the central shaft and the duct, the plurality of fins having an airfoil profile; wherein a number of the plurality of fins is less than a number of the plurality of blades.

2. The outboard motor according to claim 1, wherein the airfoil profile causes the plurality of fins to generate a forward thrust by a force of a swirling flow from the plurality of blades pushing the plurality of fins.

3. The outboard motor according to claim 1, wherein the plurality of fins are located rearward of the plurality of blades.

4. The outboard motor according to claim 1, wherein each of the plurality of fins includes a first surface facing a negative pressure side of the plurality of fins;

each of the plurality of blades includes a second surface facing a negative pressure side of the plurality of blades; and the first surface and the second surface face each other in opposite directions.

5. The outboard motor according to claim 1, wherein one of the number of the plurality of fins and the number of the plurality of blades is odd, and a number of the other of the plurality of fins and the plurality of blades is even.

6. The outboard motor according to claim 1, wherein the duct includes a stator coil; and the propeller includes a permanent magnet.

7. The outboard motor according to claim 1, wherein a pitch angle of the plurality of fins is about 4 degrees or less and about −7 degrees or more.

8. An outboard motor comprising:

a duct including a circular hole;

a propeller located in the circular hole and including a rotor and a plurality of blades radially extending from the rotor; and a plurality of fins connected to the duct, the plurality of fins having an airfoil profile; wherein a number of the plurality of fins is less than a number of the plurality of blades.

* * * * *